US005677062A

United States Patent [19]

Kuroda et al.

[11] Patent Number: 5,677,062

[45] Date of Patent: Oct. 14, 1997

[54] THERMAL TRANSFER RECORDING SHEET

[75] Inventors: Katsuhiko Kuroda; Kitaro Shigeta; Hideo Shinohara, all of Yokohama, Japan

[73] Assignee: Mitsubishi Chemical Corporation, Tokyo, Japan

[21] Appl. No.: 548,856

[22] Filed: Oct. 26, 1995

[30] Foreign Application Priority Data

Oct. 31, 1994 [JP] Japan ..... 6-267418

[51] Int. Cl.[6] ..... B41M 5/26

[52] U.S. Cl. ..... 428/411.1; 347/202; 347/211; 347/221; 428/195; 428/484; 428/488.4; 428/913; 428/914

[58] Field of Search ..... 428/195, 207, 428/484, 488.4, 411.1, 913, 914; 503/226; 347/202, 211, 221

[56] References Cited

U.S. PATENT DOCUMENTS 5,292,583 3/1994 Taki et al. ..... 428/195

5,308,681 5/1994 Taki et al. ..... 428/195

FOREIGN PATENT DOCUMENTS 0 138 483 4/1985 European Pat. Off. .

0 153 880 9/1985 European Pat. Off. .

0 562 461 9/1993 European Pat. Off. .

*Primary Examiner*—Pamela R. Schwartz

*Attorney, Agent, or Firm*—Oblon, Spivak, McClelland, Maier & Neustadt, P.C.

[57] ABSTRACT

A thermal transfer recording sheet comprising a base film, a thermally transferable ink layer formed on one side of the base film, a heat resistant lubricating layer formed on the other side of the base film, wherein the total concentration of alkali metal ions and alkaline earth metal ions contained in the heat resistant lubricating layer is within a range of at most 4 μg/cm$^2$.

16 Claims, 1 Drawing Sheet

THERMAL TRANSFER RECORDING SHEET

The present invention relates to a thermal transfer recording sheet. Particularly, it relates to a thermal transfer recording sheet which can be advantageously used for color recording of TV images or for color recording at OA terminals such as printers, facsimile machines or copying machines.

For color recording, various systems including electrophotography, ink jet recording and thermal transfer recording, have been studied. The thermal transfer recording system is advantageous over other systems with respect to the maintenance of the apparatus, easiness of operation and low costs for expendable supplies.

In the thermal transfer recording system, image-receiving sheet is laid on an ink-coated side of a thermal transfer recording sheet having a colorant-containing ink coated thereon, and the rear side of the thermal transfer recording sheet is heated by a heat source such as a thermal head, to transfer the colorant the thermal transfer recording sheet to the image-receiving sheet. Such a system includes a melting type transfer system employing a thermally meltable ink and a sublimation type transfer recording system employing an ink containing a sublimable dye.

However, in a thermal transfer recording system of this type, a thermal transfer recording sheet is heated to a high temperature by the thermal head. Accordingly, if the heat resistance of the base film for the thermal transfer recording sheet is not sufficient, the base film is likely to fuse to the thermal head, and this fusion is likely to cause a failure in smooth running of the head and bring about a sticking phenomenon or a creasing or rupture phenomenon of the sheet, whereby normal recording will be impossible. Therefore, it has been proposed to provide protective films of various heat resistant resins in order to improve the heat resistance of the base films (e.g. Japanese Unexamined Patent Publications No. 7467/1980 and No. 74195/1982). Further, it has been proposed to incorporate heat resistant fine particles, a lubricant, a surfactant or the like to the above protective layers in order to further improve the running property (e.g. Japanese Unexamined Patent Publications No. 155794/1981, No. 184883/1985 and No. 42282/1991).

However, recently, it has been common to give an energy higher than ever to a thermal head to meet the requirement for recording at a higher speed in the recording method of this system, and higher durability of the head is requested. Various factors may be mentioned which may deteriorate the function of the head. Among them, a corrosion phenomenon has become the most serious problem, and the causes for such a phenomenon are complex, so there is no effective means to prevent it.

The present inventors have conducted extensive studies to obtain a thermal transfer recording sheet excellent in the durability of the head and as a result, have found that alkali metal and alkaline earth metal ions contained in the thermal transfer recording sheet, particularly in the heat resistant lubricating layer, are the main factor of the corrosion, and it is possible to obtain an excellent thermal transfer recording sheet which scarcely causes corrosion of the head, by suppressing the total concentration of such ions to a certain range. The present invention has been accomplished on the basis of this discovery.

It has further been found that also by suppressing the concentration of fluorine contained in the thermal transfer recording sheet, particularly in the heat resistant lubricating layer, to a specific range, it is possible to obtain an excellent thermal transfer recording sheet which scarcely causes corrosion of the head.

Figure 1:
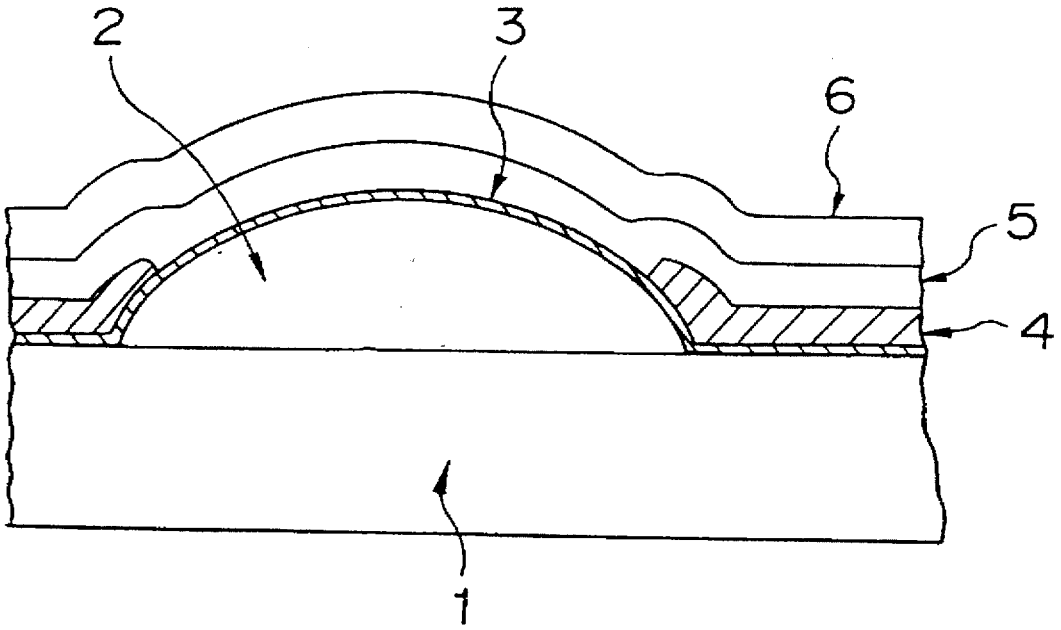
FIG. 1 is a head heating portion of a thermal head in accordance with the invention.

As the thermal head used for thermal transfer recording, the one so-called a thin film type thermal head is most common, and the head heating portion has, for example, a structure as shown in FIG. 1.

As illustrated in FIG. 1, the head heating portion comprises a radiating substrate (1) made of alumina ceramics and a glazing layer (2) formed thereon. The glazing layer (2) is usually made of glass and serves as a heat reserving layer. On this glazing layer (2), an electric resistance layer, a heating element, (3) is provided, which is made of a nitride of a highly stable metal such as Ni.Cr (nichrome) or tantalum, or a thermet (Ta–$SiO_2$, Cr–$SiO_2$ or the like). An electrical conductor (4), an electrode, which is usually made of aluminum, is provided thereon. A resistor-protecting layer (5) is provided thereon, and this layer is made of $SiO_2$ for shield against oxygen. Frther, an abrasion resistant layer (6) is formed thereon, which is made of a material having excellent abrasion resistance, such as $Ta_2O_5$, SiC or SiN.

If an ionic substance such as Na, K, Mg or Ca is contained in a color sheet, particularly in the heat resistant layer of the color sheet, the electrode of the thermal head will be negatively charged. Consequently, cations such as Na will be attracted through the abrasion resistant layer or the protecting layer, whereby cracks or pin holes are likely to form in the abrasion resistant layer or the protecting layer, or corrosion by e.g. oxidation of the electrode is likely to occur.

Further, if fluorine is contained in the color sheet, it is likely to corrode the glass in the glazing layer or the resistor protecting layer of the thermal head. Therefore, also in this case, corrosion of the thermal head is likely to be caused.

Accordingly, it is an object of the present invention to provide a thermal transfer recording sheet, which is free from corroding the head even when the thermal head is driven under a severe recording condition.

Thus, the present invention provides a thermal transfer recording sheet comprising a base film, a thermally transferable ink layer formed on one side of the base film, a heat resistant lubricating layer formed on the other side of the base film, wherein the total concentration of alkali meal ions and alkaline earth metal ions contained in the heat resistant lubricating layer is within a range of at most 4 $\mu g/cm^2$.

Now, the present invention will be described in detail with reference to the preferred embodiments.

The heat resistant lubricating layer of the present invention usually comprises a binder resin, fine particles and other additives such as a lubricant. As the binder resin, a thermosetting, radiation-curable or thermoplastic binder resin is employed. The thermosetting resin may, for example, be a crosslinked product of an isocyanate with a resin containing active hydrogen, such as an ethyl cellulose resin, a cellulose resin, a polyvinyl alcohol resin, a polyvinyl acetal resin or a polyvinyl butyral resin. The radiation-curable resin may, for example, be a polyester acrylate, an epoxy acrylate or a polyol acrylate. As the thermoplastic resin, thermoplastic resin having a glass transition temperature of at least 50° C. can be employed, and it may, for example, be an acrylic resin, a vinyl chloride copolymer, an acrylonitrile/styrene copolymer, a polycarbonate resin, a polyester resin, a polyvinyl butyral resin or a polyacetal resin.

The fine particles may, for example, be inorganic particles such as silica, alumina or titanium oxide, or organic particles such as a silicone resin, a urea resin or a benzoguanamine resin.

As the lubricant, various modified silicone oils or phosphoric acid ester type surfactants may, for example, be employed.

As mentioned above, for the composition of the heat resistant lubricating layer, it is common to incorporate fine particles, a lubricant, a surfactant or an antistatic agent to a thermosetting, radiation-curable or thermoplastic binder resin for the purpose of improving the running properties, antistatic properties or cleaning properties. However, it is usual that such an additive contains cations such as alkali metal ions or alkaline earth metal ions, as impurities or counter ions. Further, some kinds of inorganic particles or the surfactant contain fluorine to a certain extent.

The present inventors have found that if such cations and fluorine are present in a thermal transfer recording sheet, particularly in the surface of the heat resistant lubricating layer which is in contact with a thermal head, they tend to diffuse and be absorbed in the protecting film of the thermal head and will eventually reach the electrode portion and cause corrosion. This becomes more harmful especially under a high speed recording condition where a high power is applied in a short period of time. To reduce the effect of such cations, purification of raw material may be carried out, or raw materials having a low content of such cations may be selected, so that the durability against corrosion of the thermal head can be improved to a large extent. Fluorine may be controlled, for example, by selecting inorganic particles or the surfactant which have a low fluorine content whereby corrosion of the thermal head can be prevented.

Further, for the purpose of improving the running properties or the cleaning properties, silica particles are used as the fine particles in many cases. However, such silica particles contain about 1.4 wt %, based on the particles, of alkali metal ions such as sodium or potassium ions, or alkaline earth metal ions such as calcium or magnesium ions. Further, for the purpose of improving the running properties, the antistatic properties or the cleaning properties, a phosphoric acid ester of a polyoxyethylene alkyl ether is used as a surfactant in many cases, but such an ester contains sodium in an amount of 7 wt % relative to the surfactant.

It has been found that when these additives are used as they are, corrosion occurs at the electrode portion of the thermal head as a result of high speed recording for the long time. It has further been found that this corrosion phenomenon can not adequately be prevented unless they are purified until the total concentration of metal ions contained in the heat resistant lubricating layer is reduced to a level of at most 4 $\mu g/cm^2$.

This corrosion phenomenon is particularly remarkable under a high speed recording condition i.e. a recording condition where the picture element recording signal pulse cycle is at most 10 msec, preferably at most 8 msec and under a recording condition of a high energy application at a level of at least 0.3 W/dot, and in such case, it is preferred to reduce the total concentration of alkali metal ions and alkaline earth metal ions to a level of at most 2 $\mu g/cm^2$. It is particularly preferred that the total concentration of $Na^+$ and $K^+$ as alkali metal ions, and $Mg^{2+}$ and $Ca^{2+}$ as alkaline earth metal ions, is within the above range.

Among such alkali metal ions and alkaline earth metal ions, alkali metal ions are particularly responsible for corrosion, and accordingly, the total concentration of alkali metal ions is preferably at most 1 $\mu g/cm^2$. Further, among alkali metal ions, sodium ions are most likely to bring about corrosion, and accordingly the concentration of sodium ions is preferably at most 2 $\mu g/cm^2$, more preferably at most 0.1 $\mu g/cm^2$.

The concentration of fluorine is preferably at most 0.5 $\mu g/cm^2$.

On the other hand, if cationic substances are completely eliminated, the antistatic properties is reduced, and it will be required to provide another means to discharge static electricity, such being disadvantageous. Therefore, the total concentration of metal ions contained in the heat resistant lubricating layer is preferably at least 0.1 $\mu g/cm^2$, although it depends also on the recording condition. Otherwise, in order to improve the antistatic properties, a commonly employed antistatic agent may be employed as the case requires.

There is no particular restriction as to the method for determining the concentrations of alkali metal ions, alkaline earth metal ions and fluorine contained in the thermal transfer recording sheet or in the surface of the heat resistant lubricating layer. However, such concentrations can be determined by subjecting the surface to an elemental analysis by fluorescent X-ray. Namely, solutions containing predetermined concentrations of alkali metal ions and alkaline earth metal ions, such as Na, K, Mg and Ca ions, and F, are dropped in predetermined amounts on a filter paper and dried, and then subjected to an X-ray fluorometric analysis, whereby a calibration curve is preliminarily prepared. Then, the heat resistant lubricating layer side of the color sheet is subjected to an X-ray fluorometric analysis under the same condition, and the amounts of these metal ions and fluorine detected per unit area are quantitatively determined using the calibration curve.

As a coating method to be employed for forming the heat resistant lubricating layer of the present invention, various methods may be mentioned including e.g. methods of employing a gravure coater, a reverse coater and an air doctor coater, as disclosed in "Coating System" edited by Yuji Hrâsaki and published by Maki Shoten in 1979.

The thickness of the heat resistant lubricating layer formed on the base film is usually from 0.1 to 10 μm, preferably from 0.3 to 5 μm.

In the heat transfer recording sheet of the present invention, the base film on which the above heat resistant lubricating layer is to be formed, is not particularly limited and may, for example, be a polyethylene terephthalate film, a polyamide film, an aramide film, a polyimide film, a polycarbonate film, a polyphenylene sulfide film, a polysulfone film, cellophane, a triacetate film or a polypropylene film. Among them, a polyethylene terephthalate film is preferred from the viewpoint of the mechanical strength, the dimensional stability, the heat resistance, the price, etc. More preferred is a biaxially stretched polyethylene terephthalate film. The thickness of such a base film is usually from 1 to 30 μm, preferably from 2 to 10 μm.

Formation of the thermally transferable ink layer on the side of the base film opposite to the heat resistant lubricating layer, can be carried out by a conventional method. For example, in the case of a sublimation type thermal transfer recording sheet, a sublimable or heat-diffusible dye and a heat resistant binder resin are dissolved or dispersed in a suitable solvent to prepare an ink, and this ink is co,ted on a base film, followed by drying. In the case of a melting type thermal transfer recording sheet, a colorant such as a pigment or a dye is dissolved or dispersed in a thermally meltable substance, if necessary, by means of a solvent, to prepare an ink, and this ink is coated on a base film, followed by drying.

As the sublimable or heat-diffusible dyes to be used for the above sublimation type heat transfer recording sheet, various nonionic dyes such as azo dyes, anthraquinone dyes, nitro dyes, styryl dyes, naphthoquinone dyes, quinophthalone dyes, azomethine dyes, cumalin dyes and condensed polycyclic dyes, may be used. As the binder resin, a polycarbonate resin, a polysulfone resin, a polyvinylbutyral resin, a phenoxy resin, a polyarylate resin, an acrylate resin, a polyamide resin, an aramide resin, a polyimide resin, a polyetherimide resin, a polyester resin, an acrylonitrile-styrene resin, or a cellulose resin such as acetyl cellulose, methyl cellulose or ethyl cellulose, may, for example, be mentioned. As the solvent, an aromatic solvent such as toluene or xylene, a ketone solvent such as methyl ethyl ketone, methyl isobutyl ketone or cyclohexanone, an ester solvent such as ethyl acetate or butyl acetate, an alcohol solvent such as isopropanol, butanol or methyl cellosolve, an ether solvent such as dioxane or tetrahydrofuran, or an amide solvent such as dimethylformamide or N-methylpyrrolidone, may, for example, be employed.

With respect to the colorant to be used for the melting type thermal transfer recording sheet, as the pigment, an inorganic pigment such as carbon black, or various organic pigments of azo type or condensed polycyclic type, may be employed, and as the dye, an acidic dye, a basic dye, an oil-soluble dye or a metal complex dye may, for example, be employed. As the thermally meltable substance, a solid or semi-solid substance having a melting point of from 40° to 120° C. is preferred, and paraffin wax, microcrystalline wax, carnauba wax, montan wax, Japan wax or a fat type synthetic wax may, for example, be mentioned. As the solvent, the same solvents as mentioned above with respect to the sublimation type thermal transfer recording sheet may be employed.

In each of the above-mentioned inks, in addition to the above-mentioned components, additives such as organic or inorganic non-sublimable particles, a dispersant, an antistatic agent, a blocking-preventing agent, an antifoaming agent, an antioxidant and a viscosity-controlling agent may be incorporated, as the case requires. The coating method of such an ink can be carried out in the same manner as mentioned for the coating of the heat resistant lubricating layer. The thickness of the coated film is usually from 0.1 to 5 μm as a dried film thickness.

Further, in the preparation of the thermal transfer recording sheet of the present invention, to improve the adhesion between the base film and the respective layers formed by the above coating, corona discharge treatment may be applied to the surface of the base film, or primer coating treatment may be applied using e.g. a polyester resin, a cellulose resin, a polyvinyl alcohol resin, a urethane resin or a polyvinylidene chloride resin.

Now, the present invention will be described in further detail with reference to Examples. However, it should be understood that the present invention is by no means restricted to such specific Examples.

EXAMPLES 1 to 5

(a) Preparation of thermal transfer recording sheets Using a biaxially stretched polyethylene terephthalate film (thickness 5 μm) as a base film, a coating liquid having the basic composition (A), (B) or (C) as identified in Table 1 was coated on one side thereof in a wet film thickness of about 10 μm and dried at 100° C. for one minute to form a heat resistant lubricating layer.

The fine silica particles (aerosil silica) and the phosphoric acid ester surfactant used for the compositions (A), (B) and (C) were, respectively, purified or non-purified to have cation contents as identified in Table 2, and they were incorporated in the proportions as identified in Table 3 to form coating liquids for forming the heat resistant lubricating layers to be used for Examples 1 to 5, respectively. In Table 2, non-purified aerosil silica (commercial product) was identified by ①, and purified aerosil silica ② was obtained by washing a 1 wt % dispersion of aerosil silica ① in toluene with deionized water, followed by liquid separation treatment to remove water-soluble ions for purification. Further, with respect to the phosphoric acid ester surfactant, the commercial product was designated as non-purified product ③, and a 5 wt % aqueous solution of the non-purified product ③ was purified by means of a polyethylene ultrafiltration membrane (NTU-2006, manufactured by Nitto Denko) and an ultrafiltration apparatus (UW-1, manufactured by Nitto Denko), and then water was evaporated for concentration to obtain purified phosphoric acid ester surfactant ④.

On the rear side of the above film i.e. the side opposite to the heat resistant lubricating layer, an ink comprising 5 parts by weight of a sublimable dye (C.I. Solvent Blue 95), 10 parts by weight of a polysulfone resin and 85 parts by weight of chlorobenzene, was coated and dried to form an ink layer having a thickness of about 1 μm. In this manner, thermal transfer recording sheets of Examples 1 to 5 were prepared.

TABLE 1

| | Basic composition (A) | | Basic composition (B) | | Basic composition (C) | |
|---|---|---|---|---|---|---|
| | Components | parts by weight | Components | parts by weight | Components | parts by weight |
| Resin | Acrylic resin *a (Dianal BR-108) | 8.25 | Acrylic resin *a (Dianal BR-108) | 8.25 | Acrylic resin *a (Dianal BR-108) | 8.25 |
| Lubricant | Amino-modified silicone oil (KF-857) *b | 0.6 | Phosphoric acid ester surfactant *c (Plysurf A208SNa) | 0.5 | Amino-modified silicone oil (KF-857) *b | 0.6 |
| | Carboxyl-modified silicone oil (X-22-162C) *b | 0.6 | | | Carboxyl-modified silicone oil (X-22-162C) *b | 0.6 |
| Fine particles | Aerosil silica (R-812) *c | 2.0 | Aerosil silica (R-812) *c | 2.0 | Aerosil silica (R-812) *c | 2.0 |
| | Silicone resin particles (Torefil E-730S) *d | 0.25 | Silicone resin particles (Torefil E-730S) *d | 0.25 | Fluorine resin particles (Rubron L-2) *f | 0.25 |
| Solvent | Toluene | 60 | Toluene | 60 | Toluene | 60 |
| | Methyl ethyl ketone | 30 | Methyl ethyl ketone | 30 | Methyl ethyl ketone | 30 |

Manufacturers:
*a Mitsubishi Rayon Co., Ltd.,
*b Shin-Etsu Chemical Industry Co., Ltd.
*c Nihon Aerosil,
*d Toray Silicone,
*e Daiichi Kogyo Seiyaku
*f Daikin Kogyo

TABLE 2

| Starting material | Content (wt %) Na | K | Mg | Ca | Total | F |
|---|---|---|---|---|---|---|
| ①Aerosil silica (commercial product) | 1.34 | — | 0.01 | 0.01 | 1.36 | — |
| ②Purified aerosil silica | 0.01 | — | — | — | 0.01 | — |
| ③Phosphoric acid ester surfactant (commercial product) | 5.75 | — | 0.50 | 1.00 | 7.25 | — |
| ④Purified phosphoric acid ester surfactant | 0.01 | — | — | — | 0.01 | — |

(d) Transfer recording results

The ink layer side of the transfer recording sheet of each of Examples 1 to 5 prepared as described above and the resin-coated side of the image-forming sheet were put together, and transfer recording was carried out for 1 km at a density of 8 lines/nun by an application of an electric power of 0.4 W/dot at a pulse cycle of 8 msec using a partially glazed type line thermal head having a heating resistor density of 8 dots/mm on the heat resistant lubricating layer side of the thermal transfer recording sheet at 25° C. under a humidity of 50% (under a normal temperature and humidity condition). In Example 5, transfer recording was carried out at also 40° C. under a humidity of 80%. The evaluation results are shown in Table 3.

The head surface was inspected under a microscope, whereby no corrosion of the head was observed, and the running properties were excellent. In Example 5, slight corrosion of the head was observed under the high temperature high humidity condition.

TABLE 3

| | Basic composition | Silica/surfactant blend ratio | Content (μg/cm²) Na | K | Ca | Mg | Total | F | Corrosion of head* | Antistatic property |
|---|---|---|---|---|---|---|---|---|---|---|
| Example 1 | A | ①/② 1/1 | 2.0 | — | 0.05 | 0.05 | 2.1 | <0.5 | ○ | Good |
| Example 2 | A | ①/② 1/4 | 0.8 | — | — | — | 0.8 | <0.5 | ⊙ | Good |
| Example 3 | B | ② 1; ③/④ 1/3 | 1.1 | — | 0.1 | 0.2 | 1.4 | <0.5 | ○ | Good |
| Example 4 | B | ② 1; ③/④ 1/5 | 0.7 | — | 0.1 | 0.1 | 0.9 | <0.5 | ⊙ | Good |
| Example 5 | C | ①/② 1/4 | 0.8 | — | — | — | 0.8 | 1.8 | *1⊙/*2Δ | Good |
| Comparative Example 1 | A | ② 1 | <0.1 | — | — | — | <0.1 | <0.5 | ⊙ | Poor |
| Comparative Example 2 | A | ① 1 | 4.0 | — | 0.05 | 0.05 | 4.1 | <0.5 | X | Good |
| Comparative Example 3 | B | ④ 1 | <0.1 | — | — | — | <0.1 | <0.5 | ⊙ | Poor |
| Comparative Example 4 | B | ③ 1 | 4.3 | — | 0.4 | 0.7 | 5.4 | <0.5 | X | Good |

*Evaluation standards
⊙ No corrosion of the head observed, no change in the protecting layer observed.
○ No corrosion of the head observed, but a color change in the protecting layer observed.
Δ Slight corrosion of the head observed.
X Corrosion of the head distinctly observed.
*1 The results under a normal temperature and normal humidity (25° C. under humidity of 50%).
*2 The results at 40° C. under a humidity of 80%.

(b) Measurement of alkali metal ions, alkaline earth metal ions and fluorine

Using 3370E manufactured by Rigaku Denki as a fluorescent X-ray analyzer, measurements were carried out under measuring conditions of Rh vessel: 50 kV-40 mA, X-ray passage: He gas, and X-ray irradiation diameter: 30 mm, and the measured intensities (kcps) were converted to absolute amounts (μg/cm²) using a calibration curve. The calibration curve was prepared in such a manner that aqueous solutions of Na, K, Mg and Ca (concentration: 200 ppm) were, respectively, prepared and dropped on filter papers (Micro Carry) manufactured by Rigaku Denki in amounts of 0, 25, 50, 100 and 250 μl, followed by drying in air to obtain standard samples of 0, 10, 20 and 50 μg. Such samples were measure under the above conditions to obtain the calibration curve.

(c) Preparation of an image-receiving sheet

A liquid comprising 10 parts by weight of a saturated polyester resin (TR-220, tradename, manufactured by Nippon Gosei K.K.), 0.5 part by weight of an amino-modified silicone (KF393, tradename, manufactured by Shin-Etsu Chemical Industry Co., Ltd.), 15 parts by weight of methyl ethyl ketone and 15 parts by weight of xylene, was coated on a synthetic paper (Yupo FPG150, tradename, manufactured by Oji Yuka Synthetic Paper Co., Ltd.) by a wire bar, then dried (the dried film thickness of the coated layer: about 5 μm), and further heat-treated in an oven at 100° C. for 30 minutes to obtain an image-receiving sheet.

Comparative Examples 1 to 4

Thermal transfer recording sheets of Comparative Examples 1 to 4 were prepared in the same manner as in Examples 1 to 5 except that various coating liquids as identified in Table 3 were used as coating liquids for forming heat resistant lubricating layers. The thermal transfer recording sheets of Comparative Examples 1 to 4 were used for transfer recording under the same conditions as in the preceding Examples. The evaluation results are shown in Table 3.

The head surface was observed under a microscope, whereby a blistering phenomenon due to corrosion of the electrode portion of the head was observed when the total concentration of Na and metal ions was 4 μg/cm² or higher. Further, in a case where the total concentration was not higher than 0.1 μg/cm², no corrosion phenomenon of the head was observed, but electrification occurred during the running operation, whereby dust in the environment was attracted to cause soiling of the head.

What is claimed is:

1. A thermal transfer recording sheet comprising a base film, a thermally transferable ink layer formed on one side of the base film, a heat resistant lubricating layer formed on the other side of the base film, wherein the total concentration of alkali metal ions and alkaline earth metal ions contained in the heat resistant lubricating layer is within a range of from 0.1 to 2.0 μg/cm$^2$.

2. The thermal transfer recording sheet according to claim 1, wherein the alkali metal ions are $Na^+$ and $K^+$, and the alkaline earth metal ions are $Ca^{2+}$ and $Mg^{2+}$.

3. The thermal transfer recording sheet according to claim 1, wherein the total concentration of the alkali metal ions contained in the heat resistant lubricating layer is from 0.1 to 1.0 μg/cm$^2$.

4. The thermal transfer recording sheet according to claim 1, wherein the concentration of fluorine contained in the heat resistant lubricating layer is at most 0.5 μg/cm$^2$.

5. The thermal transfer recording sheet according to claim 1, which is a thermal transfer recording sheet to be used for recording under such a condition that the recording signal pulse cycle per picture element for thermal transfer is at most 10 msec.

6. A thermal transfer recording method, wherein thermal transfer recording is carried out by means of the thermal transfer recording sheet as defined in claim 1 under such a condition that the recording signal pulse cycle per picture element is at most 10 msec.

7. A recording method which comprises laying an image-receiving sheet on the ink layer side of the thermal transfer recording sheet as defined in claim 1, and heating the rear side of the thermal transfer recording sheet by a thermal head having a glazing layer, to transfer a colorant of the ink layer to the image-receiving sheet.

8. The recording method according to claim 7, wherein the glazing layer of the thermal head is made of glass.

9. A thermal transfer recording sheet comprising a base film, a thermally transferable ink layer formed on one side of the base film, and a heat resistant lubricating layer formed on the other side of the base film, wherein the total concentration of alkali metal ions and alkaline earth metal ions contained in the entire thermal transfer recording sheet is within a range of from 0.1 to 2.0 μg/cm$^2$.

10. The thermal transfer recording sheet according to claim 9, wherein the alkali metal ions are $Na^+$ and $K^+$, and the alkaline earth metal ions are $Ca^{2+}$ and $Mg^{2+}$.

11. The thermal transfer recording sheet according to claim 9, wherein the total concentration of the alkali metal ions contained in the heat resistant lubricating layer is from 0.1 to 1.0 μg/cm$^2$.

12. The thermal transfer recording sheet according to claim 9, wherein the concentration of fluorine contained in the heat resistant lubricating layer is at most 0.5 μg/cm$^2$.

13. The thermal transfer recording sheet according to claim 9, which is a thermal transfer recording sheet to be used for recording under such a condition that the recording signal pulse cycle per picture element for thermal transfer is at most 10 msec.

14. A thermal transfer recording method, wherein thermal transfer recording is carried out by means of the thermal transfer recording sheet as defined in claim 9 under such a condition that the recording signal pulse cycle per picture element is at most 10 msec.

15. A recording method which comprises laying an image-receiving sheet on the ink layer side of the thermal transfer recording sheet as defined in claim 9, and heating the rear side of the thermal transfer recording sheet by a thermal head having a glazing layer, to transfer a colorant of the ink layer to the image-receiving sheet.

16. The recording method according to claim 15, wherein the glazing layer of the thermal head is made of glass.

* * * * *